US009138653B2

(12) United States Patent
Heaven et al.

(10) Patent No.: US 9,138,653 B2
(45) Date of Patent: Sep. 22, 2015

(54) WATER RIDE ATTRACTION INCORPORATING RIDER SKILL

(71) Applicant: Whitewater West Industries Ltd., Richmond (CA)

(72) Inventors: Edwin Michael Gyde Heaven, North Vancouver (CA); Denise Weston, Wakefield, RI (US); Rick Briggs, Springfield, IL (US); Hyuma Frankowski, Vancouver (CA)

( * ) Notice: Subject to any disclaimer, the term of this patent is extended or adjusted under 35 U.S.C. 154(b) by 0 days.

(21) Appl. No.: 14/077,038

(22) Filed: Nov. 11, 2013

(65) Prior Publication Data

US 2014/0135137 A1 May 15, 2014

Related U.S. Application Data

(60) Provisional application No. 61/724,849, filed on Nov. 9, 2012.

(51) Int. Cl.
*A63G 21/18* (2006.01)
*A63G 21/00* (2006.01)

(52) U.S. Cl.
CPC ..... *A63G 21/18* (2013.01)

(58) Field of Classification Search
CPC ..... A63G 3/00; A63G 3/02; A63G 21/00; A63G 21/18; A63G 31/00; A63G 31/007; A63B 2009/008; A63B 2225/605
USPC ..... 472/13, 117, 128, 129
See application file for complete search history.

(56) References Cited

U.S. PATENT DOCUMENTS

| | | | | |
|---|---|---|---|---|
| 6,375,578 | B1 * | 4/2002 | Briggs | 472/117 |
| 6,527,646 | B1 * | 3/2003 | Briggs | 472/117 |
| 7,967,692 | B2 * | 6/2011 | Werner | 472/117 |
| 8,079,916 | B2 * | 12/2011 | Henry | 472/128 |
| 2007/0087850 | A1 | 4/2007 | Henry et al. | |

* cited by examiner

*Primary Examiner* — Kien Nguyen
(74) *Attorney, Agent, or Firm* — Greenberg Trauig

(57) ABSTRACT

A waterslide attraction capable of incorporating user skill or agility. The waterslide attraction utilizes a slide for supporting a rider, either with a ride vehicle or without. The ride vehicle may be a mat with handles that allows the rider thereon to manipulate its position or other elements while on the slide. Upon manipulating an element, a signal may be transmitted. Sensors located along the slide are configured to interact with tags having corresponding identification information, such tags either worn by the rider in accessories or embedded or coupled with the ride vehicle. When a tag is within a predetermined distance or vicinity of a sensor, one or more aspects of the waterslide attraction may be modified, such as by turning on jets of fluid or assigning score points associated with the identification information. A screen or mobile application displays various characteristics corresponding to travel performance down the slide.

20 Claims, 14 Drawing Sheets

WATER RIDE ATTRACTION INCORPORATING RIDER SKILL

CROSS REFERENCE TO RELATED APPLICATIONS

This application claims the benefit of U.S. Provisional Patent Application Ser. No. 61/724,849, filed on Nov. 9, 2012, entitled "Water Ride Attraction Incorporating Rider Skill and Agility," which is hereby incorporated by reference in its entirety.

BACKGROUND

1. Field

The present invention relates generally to water ride attractions. More particularly, the present invention relates to waterslide attractions capable of incorporating skill or agility of a user riding thereon and modifying features of the waterslide attraction in response thereto.

2. Description of the Related Art

Waterslide attractions typically provide riders with a thrilling experience of speed and lateral force upon the body as the riders slide on the attraction. A stream of water is commonly flowed along a flume from an entrance location of higher elevation to an exit location of lower elevation. A rider slides along the flume due to the stream of water, either with or without a ride vehicle, and experiences the twists, turns, and drops predetermined by the design and setup of the flume. While such attractions provide an initial rush of excitement, repeated riding of the attraction can have diminished appeal as riders become accustomed to the layout of the attraction and their merely passive interaction along its length.

Some concepts or designs have attempted to increase the excitement of a waterslide attraction even after multiple riding attempts. One such concept allowed riders to choose among a collection of preset themes prior to riding on an attraction, the lighting and sound effects changing as the rider traveled down the slide according to the theme chosen by the rider. Depending on the number of selectable themes, riders could have a different experience in subsequent ride attempts. Another concept involved adding elements of competition between two riders via a pair of parallel water slide riding surfaces. These riders could compete with one another on these riding surfaces while non-ride participants could interact with the ride to aid or hinder the rider movement from platforms positioned adjacent to the riding surfaces. Unfortunately, while these designs may have extended rider excitement more so than conventional water slides without such features, they may not have the effect of encouraging multiple attempts at riding the water attraction since riders only passively engage with the waterslide and its features.

Thus, an improved waterslide that incorporates skill or agility of the rider themselves while navigating the water slide is desired. The improved waterslide would ideally be capable of tracking user performance, either through the use of a ride vehicle or without, and generate an indication of user performance for encouraging multiple attempts at the waterslide to garner improved performance ratings. The improved waterslide would desirably promote competition between riders, even when such riders are not riding on the waterslide at substantially the same time. Moreover, the improved waterslide would desirably allow riders to gauge or analyze their own performance for improving subsequent runs down the waterslide attraction.

SUMMARY

A water ride attraction that is configured to incorporate rider skill and agility is disclosed. In one embodiment, a waterslide may include a slide having a surface for supporting a rider thereon. A sensor is coupled with the slide and a tag having identification information associated therewith is configured to be sensed by the sensor when within a predetermined distance of the sensor. A reward component is in communication with the sensor and configured to reward the rider on the slide based on a position of the rider on the slide. The tag may be coupled to the rider via an article of clothing or accessory worn by the rider or may be coupled with a ride vehicle that is configured to support the rider and slide along the surface of the slide.

In another embodiment, a waterslide for incorporating skill or agility of a rider may include a slide having a surface for supporting the rider thereon, a sensor coupled with the slide, a tag having identification information associated therewith, the tag configured to be sensed by the sensor when within a predetermined distance of the sensor, and a reward component in communication with the sensor and configured to reward the rider on the slide based on a position of the rider on the slide.

In yet another embodiment, a ride vehicle for a waterslide may include a supporting surface configured to support the rider thereon and travel with the rider on the waterslide, a handle coupled with the supporting surface configured to be held by the rider, and a button adjacent to the supporting surface and configured to be pressed by the rider while the rider travels on the waterslide.

In still another embodiment, a waterslide for incorporating skill of a rider may include a slide having a surface for supporting the rider thereon, a controller having at least one button for manipulated by the rider while the rider slides on the surface of the waterslide, the controller configured to transmit a signal upon manipulation of the at least one button by the rider, a receiver configured to receive the signal, and a feature of the waterslide configured to respond to receipt of the signal by the receiver.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale and may be exaggerated to better illustrate the important features of the present invention. In the drawings, like reference numerals designate like parts throughout the different views, wherein:

DETAILED DESCRIPTION

The detailed description of exemplary embodiments herein makes reference to the accompanying drawings and pictures, which show the exemplary embodiments by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
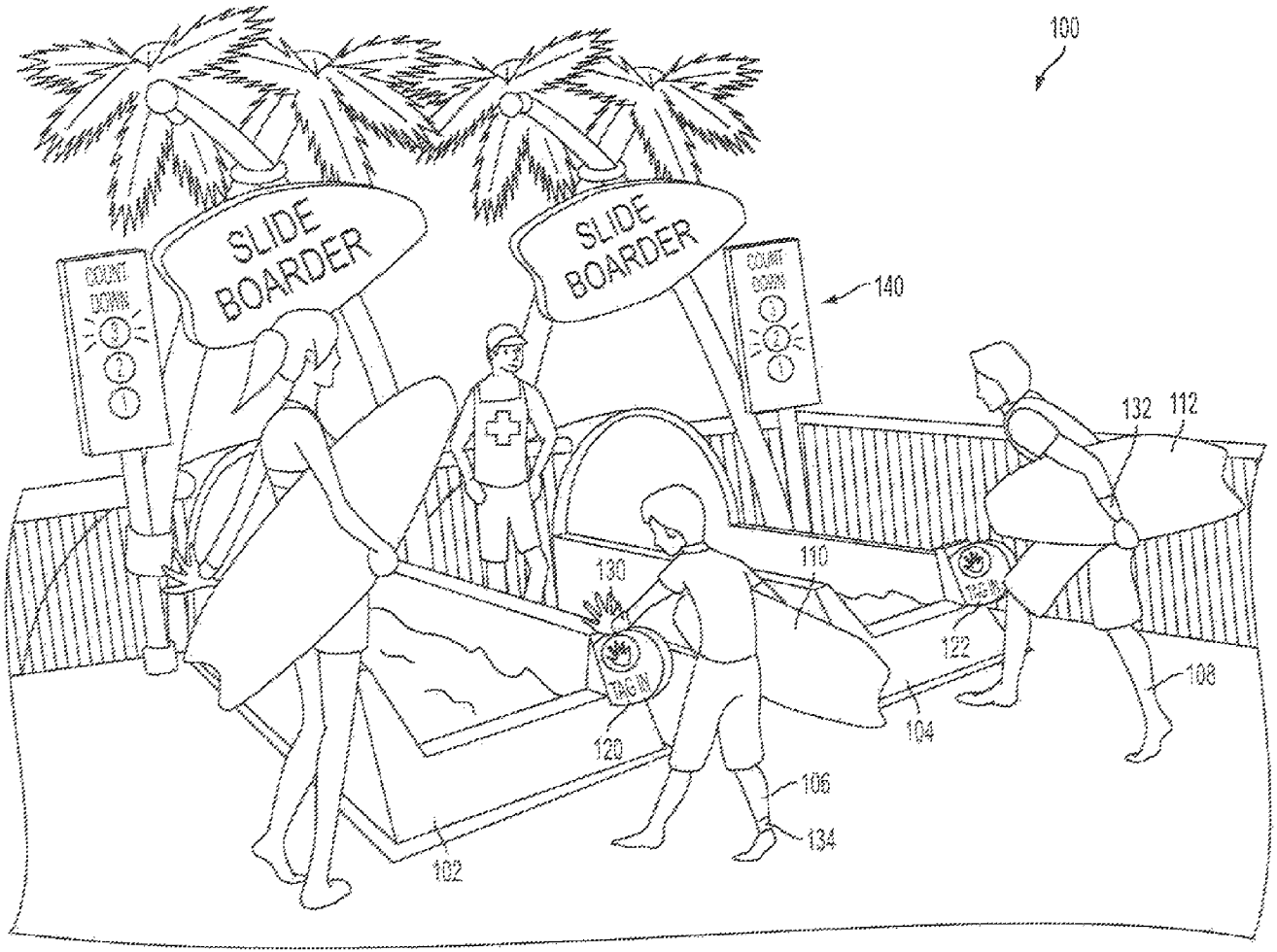
FIG. 1 shows a perspective view of an entrance to a waterslide attraction capable of incorporating skill or agility of a user riding thereon according to an embodiment of the present invention.

Turning first to FIG. 1 a perspective view of an entrance 100 to a waterslide attraction capable of incorporating skill or agility of a user riding thereon is shown. A first slide or flume 102 and a second slide or flume 104 are shown adjacent to one another at the entrance 100 to the waterslide attraction. A first rider 106 may ride down the first slide 102 utilizing a first slideboard 110 or other ride vehicle. Similarly, a second rider 108 may ride down the second slide 104 utilizing a second slideboard 112 or other ride vehicle. The ride vehicles may be inflatable rafts capable of holding one or more riders, body boards, foam mats, etc. In an alternative embodiment, no ride vehicles may be used. Such a multi-slide setup may promote competitiveness between two or more riders who are allowed to race or otherwise compare their travel times from the entrance 100 to an exit of the waterslide attraction. For example, a countdown 140 may be displayed at the entrance 100 for letting the riders (106, 108) know when to begin their descent down the waterslide attraction. The countdown 140 may be a series of lights as shown, a timer that ticks down numerically, or any other type of display or cue (audible, vibration, etc.) for letting the riders (106, 108) know to begin their ride.

The first rider 106 wears a wrist band 130 that includes a tag (e.g., a radio frequency identification ("RFID") tag) that is sewn or otherwise disposed thereon or therein. This tag is configured to interact with various sensors disposed along the waterslide attraction when the first rider 106 moves the wrist band 130 within a predetermined distance of the various sensors while riding the waterslide attraction. When the tag is moved within the predetermined distance, score points may be generated or obtained for the first rider 106 or certain features of the first slide 102 may be modified, as discussed in greater detail herein. In an alternative embodiment, the tag may be fastened or worn by the rider 106 in any of a variety of other ways (e.g., ankle bracelet, headband, sewn, glued, pinned, or otherwise affixed to an article of clothing worn by the rider, etc.).

The second rider 108 similarly wears a wrist band 132 that includes a tag. The tag of the wrist band 132 includes different identification information from the tag of the wrist band 130 so that the waterslide attraction may appropriately differentiate between the two riders (106, 108), for example, for score-keeping purposes. In an alternative embodiment, the tag may be fastened or worn by the second rider 108 in any of a variety of other ways (e.g., ankle bracelet, headband, sewn, glued, pinned, or otherwise affixed to an article of clothing worn by the rider, etc.). In order to sync or setup the waterslide attraction for the riders (106, 108) prior to their descent, the entrance 100 includes a first tag-in sensor 120 corresponding to the first slide 102 and a second tag-in sensor 122 corresponding to the second slide 104. Prior to traveling down the slides (102, 104), each of the riders (106, 108) must first identify themselves to the waterslide attraction by moving their respective wrist bands (130, 132) within a predetermined distance of the corresponding tag-in sensors (120, 122). For example, an audible or visual cue may notify each of the riders (106, 108) when tag-in has been successful. In one embodiment, this may be accomplished by illuminating one of the lights of the countdown 140.

Certain riders may opt to wear additional straps or accessories containing tags. In an alternative embodiment, other methods or components may be used for identifying a rider (e.g., bio-metrics). As shown, the first rider 106 is also wearing an ankle strap 134 with a tag therein or thereon. The tag of the ankle strap 134 may be configured to have the same identification information as the tag of the wrist band 130 such that the waterslide attraction associates only one unique identification information per rider. In an alternative embodiment, the waterslide attraction may be setup such that unique identification information is tracked for different body parts of a same rider. In such a case, the tag of the wrist band 130 and the tag of the ankle strap 134 may be configured to have different identification information. Riders who desire a more complex or challenging ride on the waterslide attraction may choose to utilize a greater number of tags affixed to various clothing or accessories. An alternative embodiment may utilize any number of tags attached to or within any number of clothing accessories. Tags may additionally or alternatively be maintained within or on the slideboards (110, 112) as discussed in greater detail herein. In still another embodiment, the tags may be coupled with the slide while the sensors are worn by the riders or coupled with the ride vehicles.

Figure 2A:
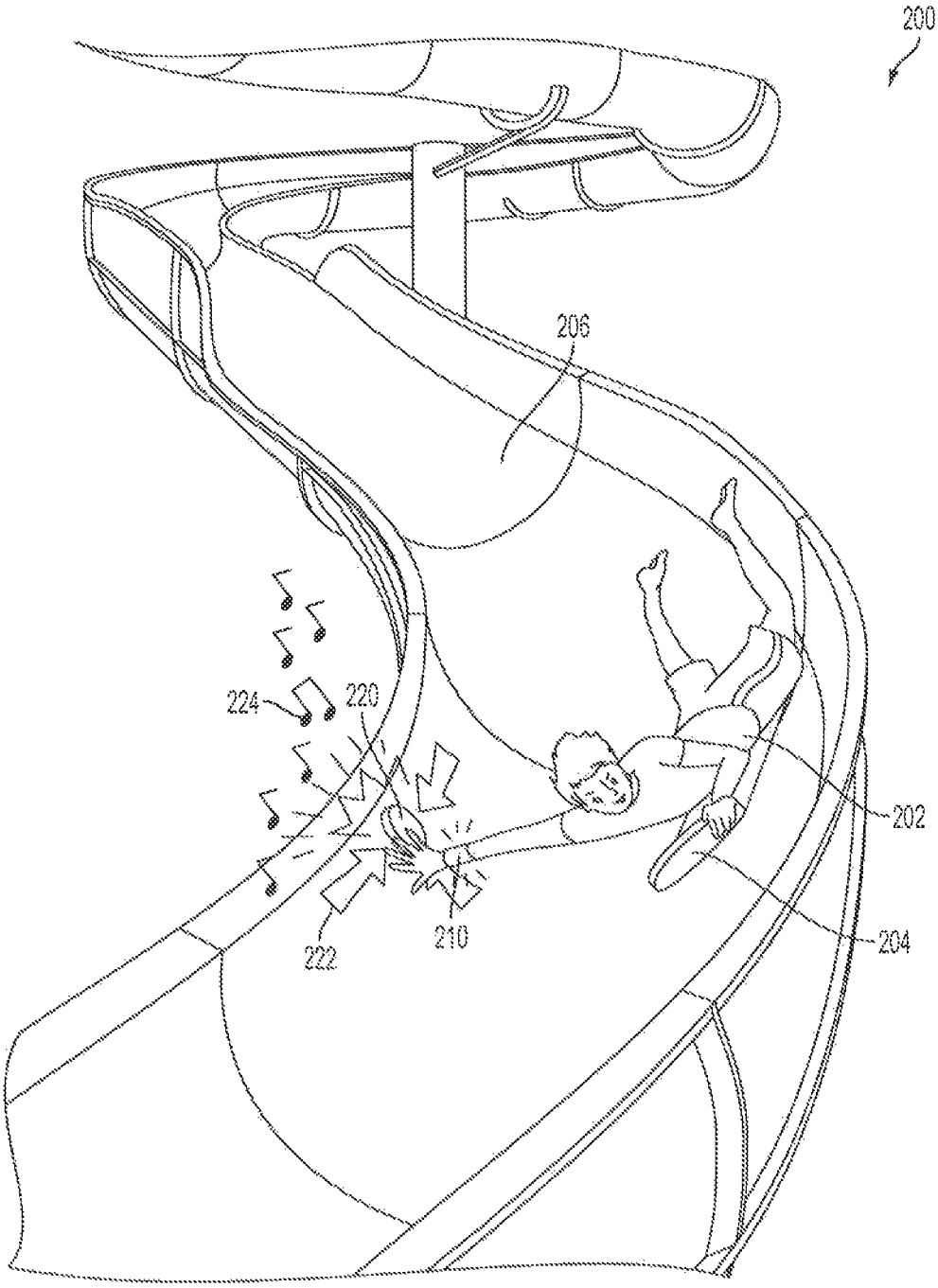
FIG. 2A shows a perspective view of a flume portion of a waterslide attraction capable of incorporating skill or agility of a user riding thereon with a slideboard according to an embodiment of the present invention.

Turning next to FIG. 2A, a perspective view of a slide or flume portion 200 of a waterslide attraction is shown. The waterslide attraction may be the same or similar as previously discussed. The slide portion 200 is configured to incorporate skill or agility of a user 202 riding thereon, as discussed below. The user 202 rides the slide portion 200 in a front-facing and stomach-down position via a slideboard 204 that is configured to support the user 202 thereon and ride upon a flow of water flowing along a sliding surface 206 of the slide portion 200. Alternative ride positions may be used in alternative embodiments and as discussed in more detail herein. For example, multi-person luges, with or without vehicle ride vehicles strapped to the persons, may be utilized.

In addition to manipulation of the slideboard 204, the user 202 may also have one or more tags 210 affixed thereto (e.g., via clothing, straps, or other accessories worn or coupled to the user 202) for demonstrating skill or agility while riding the slide portion 200. As described above, the tags 210 may be affixed or held by the user 202 in any of a variety of manners. For example, one or more tags 210 may be embedded or fastened with or within a controller (e.g., a videogame gamepad) with buttons or other interactive elements that a user can manipulate with their fingers and/or hands as they slide down the slide portion 200. The controller can be fastened to the slideboard 204 or other ride vehicle in a convenient location to allow for manipulation by the user 202 (e.g., on or adjacent to handles of the slideboard 204 or other ride vehicle). In certain embodiments, buttons and/or tags 210 may be coupled directly onto the handles or other portion of the ride vehicle.

The slide portion 200 may have one or more sensors 220 coupled thereto that are configured to interact with the tag 210 worn by the user 202 when the tag 210 comes within a predetermined distance of the sensor 220. This distance to the sensor for triggering may be adjusted based upon age, talent of the user, etc. In this manner, various sensors 220 may be positioned at various locations along the slide portion 200 for requiring the user 202 to either reach a limb containing a tag 210 near or adjacent to a respective sensor 220, manipulate the position of the slideboard 204 within the slide portion 200 in order for the respective sensor 220 to appropriately detect the tag 210, or otherwise interact with the respective sensor 220 when the tag 210 is near or adjacent, for example, by pressing a button upon controller or gamepad or upon a portion of a ride vehicle, as previously discussed. Once detection occurs, any of a variety of features or aspects of the waterslide attraction may be modified, as discussed in greater detail herein.

In order to identify to the user 202 how to interact with the slide portion 200, various cues may be displayed or otherwise made available to the user 202. For example, visual indications 222 may be disposed along the slide portion 200 for indicating the presence of a sensor 220 that the user 202 may desire to interact therewith. In one embodiment, the visual indication 222 may be a green arrow for telling the user 202 to move the tag 210 adjacent thereto. In another embodiment, different colored or shaped visual indications may represent different manners that the user should interact with the sensor 220, either by moving the tag within a predetermined distance or by pressing a button when the tag is within a predetermined distance, as discussed in greater detail below. In still another embodiment, the visual indication 222 may be a red "X" for telling the user 202 to keep the tag 210 away therefrom or that the user is positioned on a wrong side of the slide portion 200. Audible indications 224 may also be associated with the sensor 220. For example, specific tones or noises may be played near the sensor 220 for similarly advising a user 202 how to interact with the sensor 220, similar to the discussion above for the visual indications 222. Thus, audio and/or visual elements may be used for positive and/or negative indications.

Visual and/or audible notifications may also be used after a user has moved or failed to move the tag 210 within an appropriate distance from the sensor 220. For example, a particular musical tone or light may be enabled to indicate that the tag 210 was sensed by the sensor 220. Similarly, a different musical tone or light may be enabled to indicate that the tag 210 was not sensed by the sensor 220 when the user 202 was in the vicinity. In an alternative embodiment, a lack of any musical tone or light may be used to indicate that the tag 210 was not sensed by the sensor 220 when the user 202 was in the vicinity.

Figure 2B:
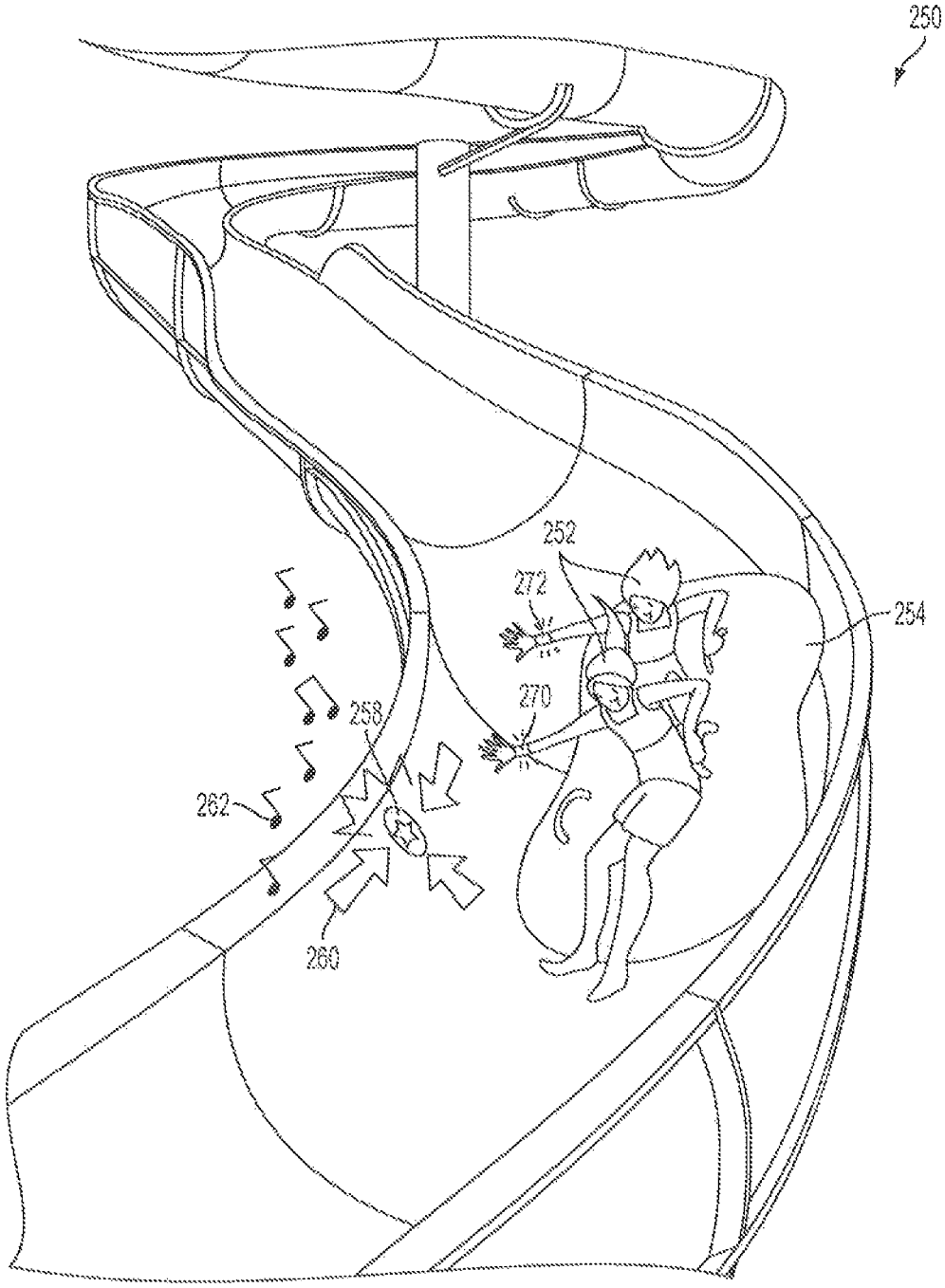
FIG. 2B shows a perspective view of a flume portion of a waterslide attraction capable of incorporating skill or agility of a plurality of users riding thereon with an inflatable tube according to an embodiment of the present invention.

FIG. 2B shows a perspective view of a slide or flume portion 250 of a waterslide attraction, similar to the discussion above for FIG. 2A, but demonstrates a plurality of riders 252 utilizing an inflated tubing device 254 for riding thereon. Similar to the discussion above, visual indicators 260 and/or audible indicators 262 act in conjunction with one or more sensors 258 disposed along the slide portion 250 for sensing one or both tags (270, 272) of the plurality of riders 252. In one embodiment, identification information may be different for the tags (270, 272), for example, to permit riders traveling together down the waterslide attraction to compete for obtaining different high scores. In an alternative embodiment, identification information may be the same for the tags (270, 272), for example, to permit riders traveling together down the waterslide attraction to cooperate for obtaining a single high score.

Any of a variety of water riding devices may be utilized in alternative embodiments. For example, although a slideboard or an inflatable tube is shown in FIGS. 2A and 2B, respectively, certain embodiments may utilize other mats or riding surfaces in addition thereto or alternatively therefrom. Tags may be included within or on the riding vehicle in addition to or in replacement of the tags worn by riders. As previously discussed, activation mechanisms (e.g., buttons, switches, knobs, or other interactive elements, etc.) that may be activated or manipulated by a user can be coupled directly with or embedded in a portion of a riding vehicle (e.g., on or near handle bars). Thus, as a user slides down the waterslide on the riding vehicle, if a visual indicator lights up a blue color when the user is within a vicinity of a sensor, the user may activate (e.g., press) a corresponding activation mechanism (e.g., a blue button) that is coupled with the riding vehicle. In another embodiment, no water riding device may be utilized, instead allowing a rider to travel down the waterslide attraction using only their own body.

Various of the targets may have differing shapes, colors, sizes, etc. for indicating difficulty level and a correspondingly different point or score allocation for hitting them. Riders can manipulate the ride vehicle to hit the desired targets, for example by shifting their weight (e.g., pressing down to counteract a lifting force to trigger a sensor, pulling or pushing on one or more of the handles to steer the ride vehicle towards or away from targets, etc.). Manipulation of the ride vehicle can also occur, for example, by pressing a button or other interactive element coupled with the ride vehicle that corresponds to the desired target (e.g., a button with the same shape and/or color as the target) as the ride vehicle passes within a predetermined vicinity of the target. In this manner, riders may ride the ride without taking their hands off of the handles or other grasping locations of the ride vehicle, instead steering the ride vehicle towards a particular target by applying pressure, leaning their body, or otherwise manipulating the travel direction or elements of the ride vehicle. Such operation prevents users from having to explicitly let go of the ride vehicle or move one of their body parts away from the ride vehicle to activate a target. Ride vehicles designed for multiple individuals to ride at once may require more than one rider to act cooperatively in order to effectively maneuver the vehicle to reach certain targets. The sensor targets may be distributed through various curves or drops of the slide path, the accumulated points displayed for each rider upon exiting the slide. Bonus points may also be awarded for hitting a particular number of targets in a row or in a particular sequence.

The slide path for one or more riders to travel along may include singles paths, dual paths, or a plurality of paths. In addition, waterslides or other water attractions that are currently in existence may be retrofitted with such sensor targets, thereby giving new life to older water attractions by permitting a sense of competitiveness within older rides (e.g., reaching a fastest speed, reaching a tallest height, etc.). Certain slide configurations may provide for sensor targets to be built into the slide path for allowing a rider to accumulate points upon riding over the sensors with actuating devices or other sensed elements built into a ride vehicle utilized by the rider, even without any other speed-boosting or speed-decreasing features. Preferably, the ride vehicle will be a mat having handles and a shape or configuration for allowing the rider to manually position or orient the mat as desired while lying face-forward and stomach-down upon the mat. Alternative embodiments for the ride vehicle may allow for vehicles supporting a rider feet first upon their back and any of a variety of shapes for tubing devices or other ride vehicles as desired.

Figure 3A:
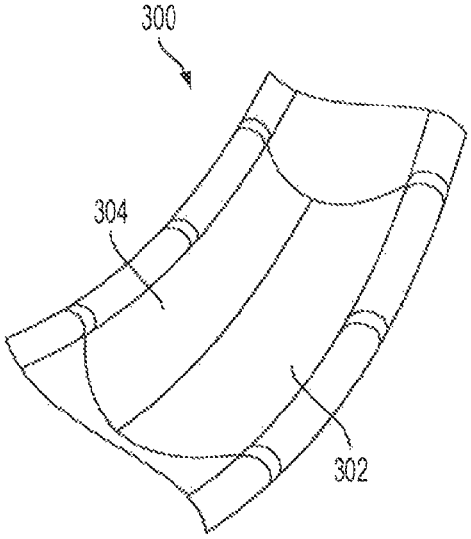
FIG. 3A shows a perspective view of a segment of a waterslide attraction utilizing a plurality of surfaces for incorporating rider skill or agility during use according to an embodiment of the present invention.
Figure 3B:
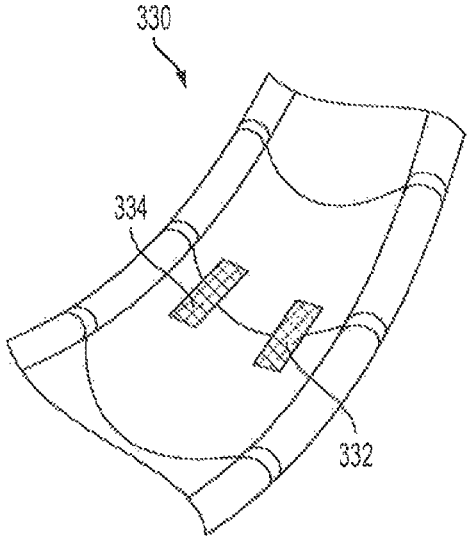
FIG. 3B shows a perspective view of a segment of a waterslide attraction utilizing a plurality of magnetic plates for incorporating rider skill or agility during use according to an embodiment of the present invention.
Figure 3C:
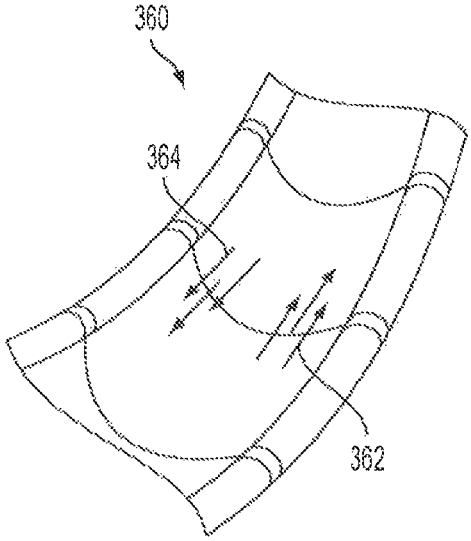
FIG. 3C shows a perspective view of a segment of a waterslide attraction utilizing a plurality of water jets for incorporating rider skill or agility during use according to an embodiment of the present invention.

FIGS. 3A-3C demonstrate a variety of possible features of a waterslide attraction that may interact with or be modified by a rider traveling thereon. The waterslide attraction may be the same as or similar to those previously discussed. Looking first at FIG. 3A, a perspective view of a slide segment 300 of a waterslide attraction utilizing a plurality of different surfaces is shown. A first surface 302 is configured to provide a lessened resistance to movement of a board, tube or human body sliding thereon than a second surface 304. For example, the first surface 302 may be constructed with an outer surface that is smoother, made of a different material or covered with a different wax than that of the second surface 304. A board, tube or human body sliding on the first surface 302 would thus be permitted to travel there along at a higher rate of speed than if the board, tube or human body were sliding on the second surface 304. In this fashion, manipulation by the rider of their position on the slide segment 300 may result in a faster or slower rate of speed along the slide segment 300.

FIG. 3B shows a perspective view of a slide segment 330 of a waterslide attraction utilizing plates or components (e.g., magnetized sheets or electrified elements) disposed along or under a surface of the slide segment 330. A first plate 332 may be configured to provide a boost of speed to a board or tube that travels adjacent thereto or upon activating one or more sensors upstream thereof (e.g., by successfully pressing a button on a gamepad or embedded on the ride or tube in response to a visual indicator when passing within a vicinity of a particular sensor). For example, a corresponding plate or other component within or affixed to the board or tube may interact with the first plate 332 such that the board or tube is propelled with additional speed down the slide segment 330 of the waterslide attraction. A second plate 334 may alternatively be configured to provide a reduction of speed to the board or tube that travels adjacent thereto or upon failing to activate one or more sensors upstream thereof. For example, a corresponding plate or other component within or affixed to the board or tube may interact with the second plate 334 such that the board or tube is slowed in its movement down the slide segment 330 of the waterslide attraction. In this fashion, manipulation by the rider of their position on the slide segment 330 may result in a faster or slower rate of speed along the slide segment 330.

FIG. 3C shows a perspective view of a slide segment 360 of a waterslide attraction utilizing jets (e.g., water jets or air jets) disposed along or flush with a surface of the slide segment 360. A first jet 362 may be configured to provide a boost of speed to a board or tube that travels over or near the first jet 362 or upon activating one or more sensors upstream thereof. For example, the first jet 362 may be configured to flow water or air in substantially the same direction as water already flowing on the slide segment 360 such that the board or tube is propelled with additional speed down the slide segment 360. A second jet 364 may alternatively be configured to provide a reduction of speed to the board or tube that travels over or adjacent thereto or upon failing to activate one or more sensors upstream thereof. For example, the second jet 364 may be configured to flow water or air in substantially the opposite direction as water already flowing on the slide segment 360 such that the board or tube is propelled with additional speed down the slide segment 360. In this fashion, manipulation by the rider of their position on the slide segment 360 may result in a faster or slower rate of speed along the slide segment 360.

Thus, in reference to each of FIGS. 3A-3C, a user riding upon the board or tube may manually direct the board or tube over or adjacent to the speed-increasing features (i.e., the first surface 302, the first plate 332, the first jet 362) while trying to avoid the speed decreasing features (i.e., the second surface 304, the second plate 334, the second jet 364) in order to speed up the rate of movement of the board or tube traveling down the waterslide attraction. In an alternative embodiment, a tag coupled with the user may interact with the speed-increasing or speed-decreasing features rather than a component of a ride vehicle (e.g., the user may position their arm or leg coupled with the tag in a vicinity of a sensor along the waterslide attraction to enable a speed-increasing feature).

Such operation may reduce the overall time traveling down the waterslide attraction and provide for a more thrilling experience. Moreover, if the waterslide attraction is configured to keep track of a user's elapsed time, skillfully maneuvering over speed-boost features may result in a quicker total time for competitive or racing considerations. Each of the features discussed in FIGS. 3A-3C may be configured in a variety of combinations or configurations as desired. Each of the features discussed in FIGS. 3A-3C may be additionally be identified to a user via cues (e.g., visual or audible), the same or similar as previously discussed. Thus, speed-boosting or speed-slowing portions of the waterslide attraction will be identifiable by a rider for the use of their skill or agility to obtain a faster or more thrilling experience.

Figure 3D:
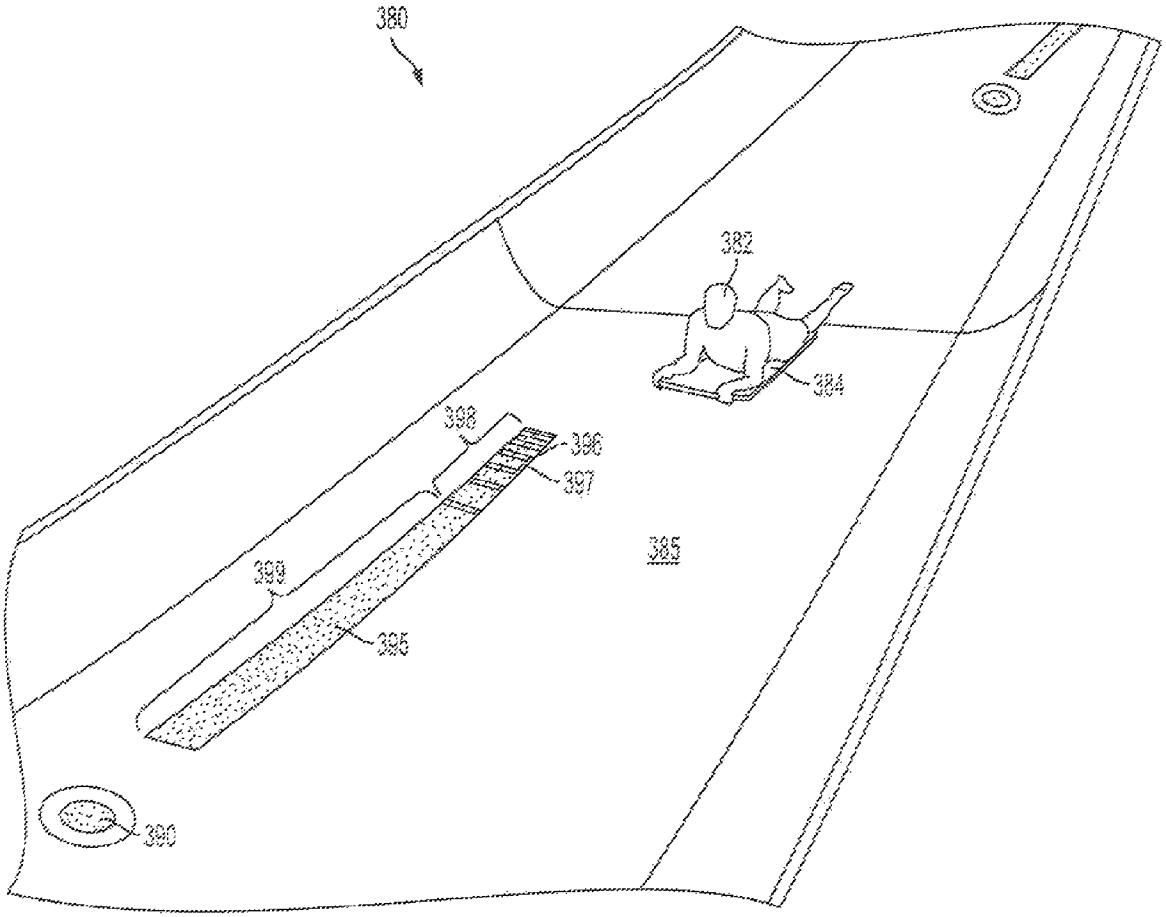
FIG. 3D shows a perspective view of a segment of a waterslide attraction utilizing a maneuvering strip for incorporating rider skill or agility during use according to an embodiment of the present invention.

FIG. 3D demonstrates a slide segment 380 of a waterslide attraction utilizing a maneuvering strip for incorporating rider skill or agility. The slide segment 380 has a wide sliding surface 385 upon which a rider 382 engaged with a ride vehicle 384 may slide upon and has room to accommodate rotation of the ride vehicle 384 and the rider 382. A maneuvering strip 395 is disposed along a portion of the sliding surface 385 and is made of a material configured (e.g., laid over the slide in key locations) to exert a higher frictional force upon the ride vehicle 384 when contacting the ride vehicle 384. Thus, when a sensor 390 (e.g., an RFID reader and/or indicator) is located in or on the sliding surface 385 of the slide segment 380, the rider 382 may skillfully manipulate the ride vehicle 384 such that a portion of the ride vehicle 384 engages with the maneuvering strip 395. This engagement causes rotation of the ride vehicle 384 due to the greater frictional force exerted on a first area of the ride vehicle 384 by the maneuvering strip 395 versus the lower frictional force exerted on a second area of the ride vehicle 384 by the sliding surface 385.

The maneuvering strip 395 may be made up of discrete materials capable of exerting differing amount of frictional force upon the ride vehicle 384. For example, a first material 396 may have a higher frictional coefficient than a second material 397. As shown, the rider 382 may obtain a faster or greater rate of rotation upon initially hitting the maneuvering strip 395 in a first area 398 having a greater amount of the first material 396. The rider may obtain a slower or lessened rate of rotation upon hitting the maneuvering strip 395 in a second area 399 having a lesser amount of the first material 396. Thus, by using such maneuvering strips 395, the rider 382 may desirably orient the ride vehicle 384 so that a particular portion or location of the ride vehicle 384 is adjacent to the sensor 390 (e.g., an RFID tag located on a side location of the ride vehicle 384 may be controlled to pass over the sensor 390). In an alternative embodiment, any of a variety of methods for allowing a user to control the orientation of a ride vehicle may be employed (e.g., magnetic strips, water or air jets, etc.)

Figure 4:
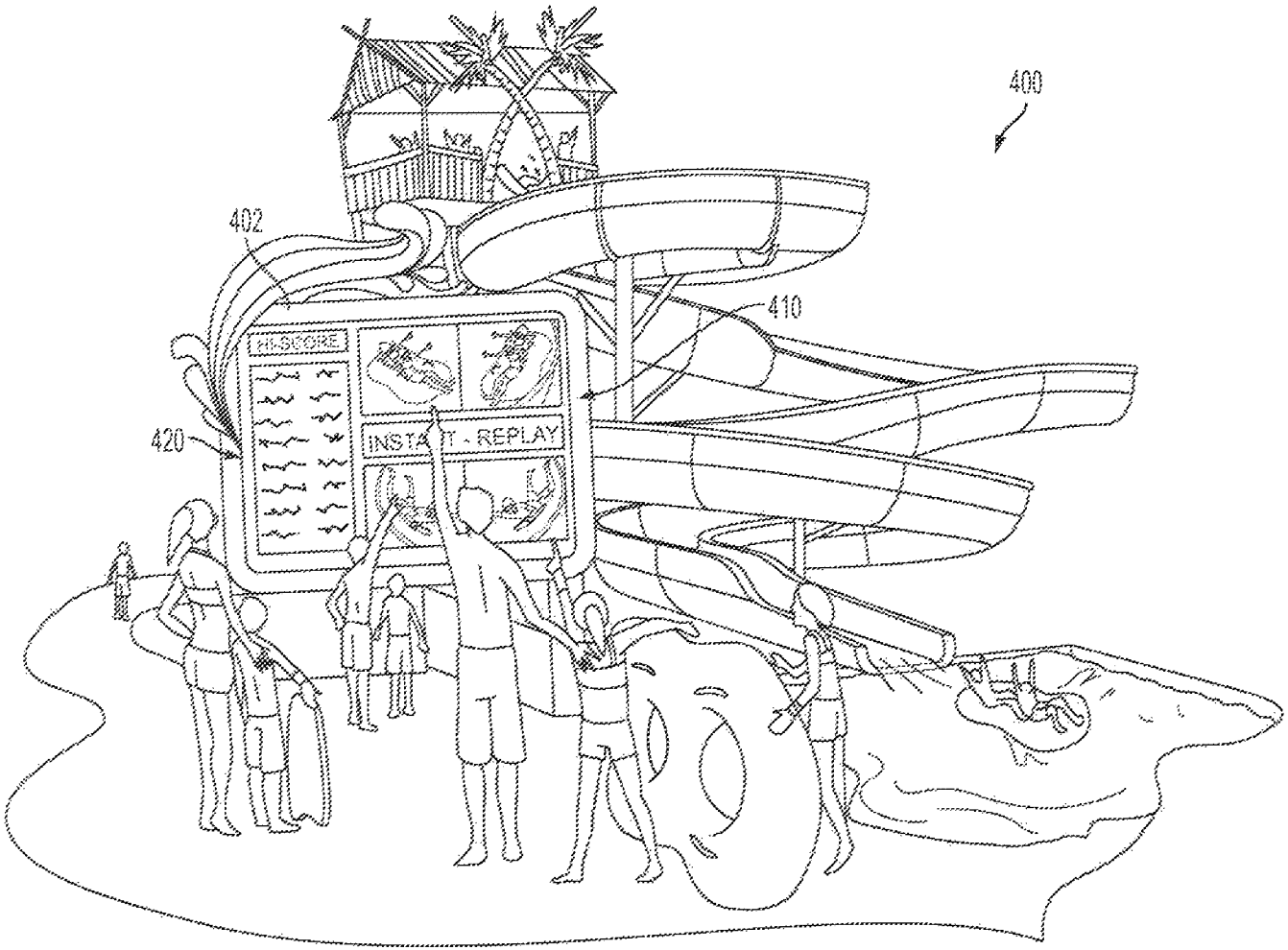
FIG. 4 shows a perspective view of an exit from a waterslide attraction capable of incorporating skill or agility of a user riding thereon and having a scoreboard according to an embodiment of the present invention.

FIG. 4 next shows a perspective view of an exit 400 from a waterslide attraction capable of incorporating skill or agility of a user riding thereon. The waterslide attraction may be the same as or similar to those previously discussed. One method of showcasing the skill or agility of these users is via a scoreboard 402 displayed to the users after they exit from the waterslide attraction. The scoreboard may have an instant replay section 410 and a scoring section 420, as discussed in greater detail below.

The instant replay section 410 provides riders the ability to view their performance after completing a ride down the waterslide attraction. For example, a tracking system (e.g., utilizing sensors for detecting a presence of tags worn by the rider or coupled with a ride vehicle supporting the rider, as discussed above) may keep record of the traversal by the rider down the waterslide attraction. Depending upon the detection of the tags in the vicinity of the sensors, a travel path down the waterslide attraction may be ascertained. This travel path may then be animated using an avatar representing the rider and displayed on the instant replay section 410 of the scoreboard 402. In certain embodiments, a rider may decide to keep a copy of the instant replay, for example, by downloading it to a personal electronic device (smart phone, tablet, etc.) for future viewing. An alternative embodiment may utilize one or more cameras or video cameras positioned along the waterslide attraction for determining and/or showcasing rider travel path.

The scoring section 420 of the scoreboard 402 provides riders the ability to view a tally or score after completing travel down the waterslide attraction. For example, points may be accumulated by successfully manipulating a ride vehicle with a tag or a tag worn by a rider within a predetermined distance of one or more sensors positioned along the waterslide attraction. Certain sensors may be worth more points than other sensors, thereby allowing riders with better skill or agility in reaching those sensors to achieve higher scores. In addition or alternatively, scores may be obtained based upon elapsed time of travel from the entrance of the waterslide attraction to the exit. Thus, riders who successfully navigate speed boosters or successfully avoid speed reducers along the waterslide attraction (for example, as discussed above) may achieve a higher score indicative of their lower elapsed time. Encouraging such competitive characteristics makes such waterslide attractions into a potential event for contests, sports, teams, leagues, etc.

Figure 5A:
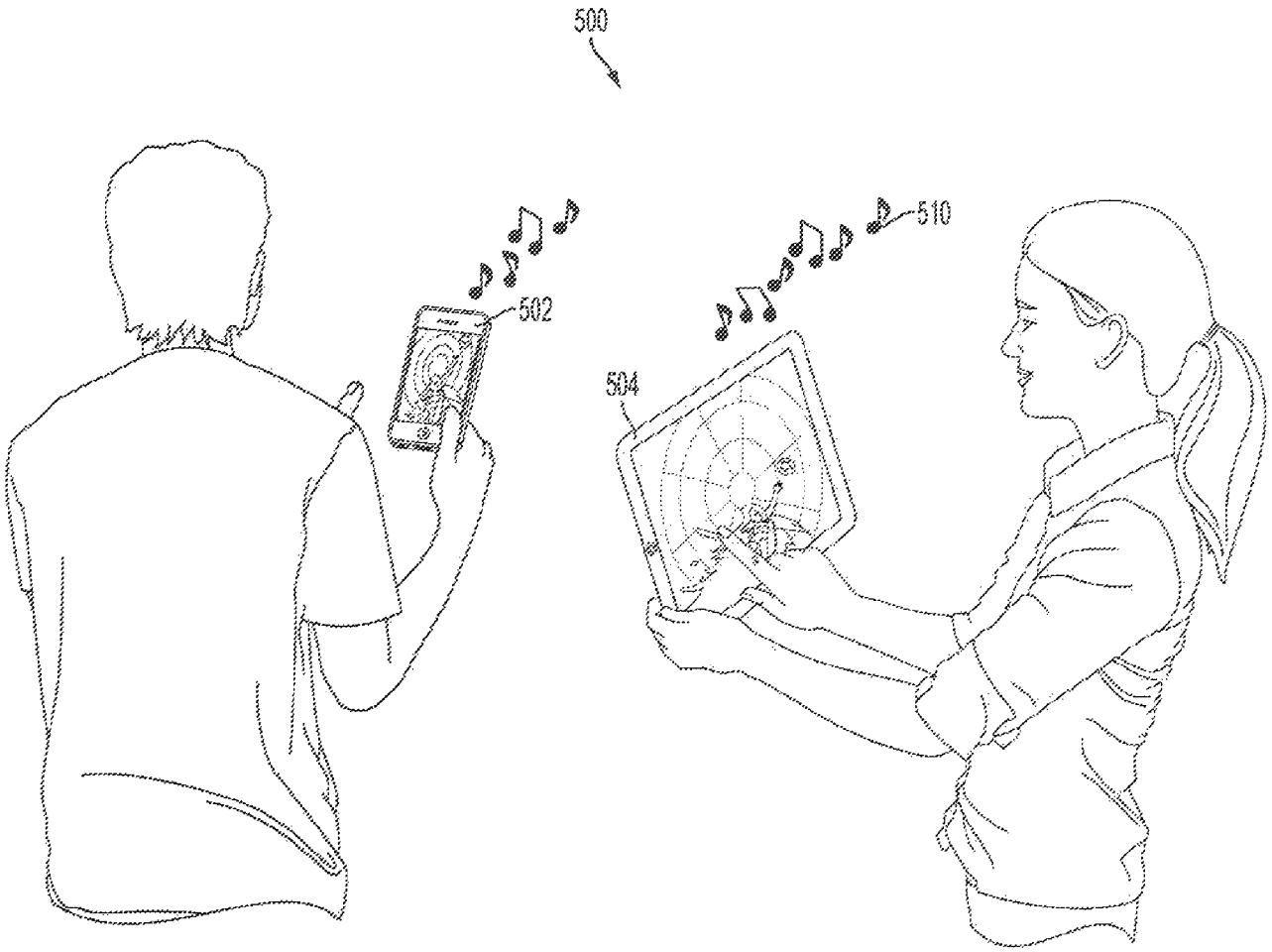
FIG. 5A shows a plurality of mobile applications corresponding to a waterslide attraction capable of incorporating skill or agility of a user riding thereon according to an embodiment of the present invention.

FIG. 5A shows the use of a mobile application 500 corresponding to a waterslide attraction capable of incorporating skill or agility of a user riding thereon. The waterslide attraction may be the same as or similar those previously discussed. The mobile application 500 may be configured to run on smart phones 502, tablets 504, or any of a variety of other electronic devices, such as laptops. The mobile application 500 may be adapted to display a history of scores or points accumulated for each attempt of a particular waterslide attraction, display of the highest score achieved for the waterslide attraction, and/or an animation or video showcasing a replay of one or more attempts of the waterslide attraction. Not only can the mobile application 500 provide a fun keepsake for memorializing a day at a waterpark, but more competitive individuals may use the replay functions or other features of the mobile application 500 to better improve their scores or elapsed time in subsequent attempts of the waterslide attraction. For example, the mobile application 500 may keep track of precisely which sensors were "hit" (e.g., when a rider tag was moved within a predetermined vicinity) and which sensors were "missed," thus allowing a user to study past attempts and learn from prior mistakes. If button presses in addition to sensor vicinity are used by the waterslide attraction, similar to the descriptions above, the mobile application 500 may additionally keep track of which button presses were successfully manipulated.

Music 510 or other audible sounds may accompany a replay shown by the mobile application 500. In certain embodiments, a user of the mobile application 500 may be permitted to choose their own music for a given replay, for example, to save and show off a particularly impressive run. The mobile application 500 may also include a game with a waterslide layout being the same or similar to a corresponding waterslide attraction so that users can manipulate an avatar to "hit" sensors, enable speed boosters, etc., the same or similar as on the actual waterslide attraction. Visual and audible notifications may accompany the game to provide a fun video gaming experience. Such mobile applications 500 may allow users to download particular ride configurations (e.g., mobile applications may be created for particular waterparks) that mirror actual attractions, for example, so that potential riders can practice on the mobile application 500 before arriving at a given water attraction. Such mobile applications 500 may allow high scorers to receive videos and pictures as rewards for their accomplishments or to have the pictures tweeted and/or posted to social media sites, such as Twitter, Facebook, Google+, etc.

Figure 5B:
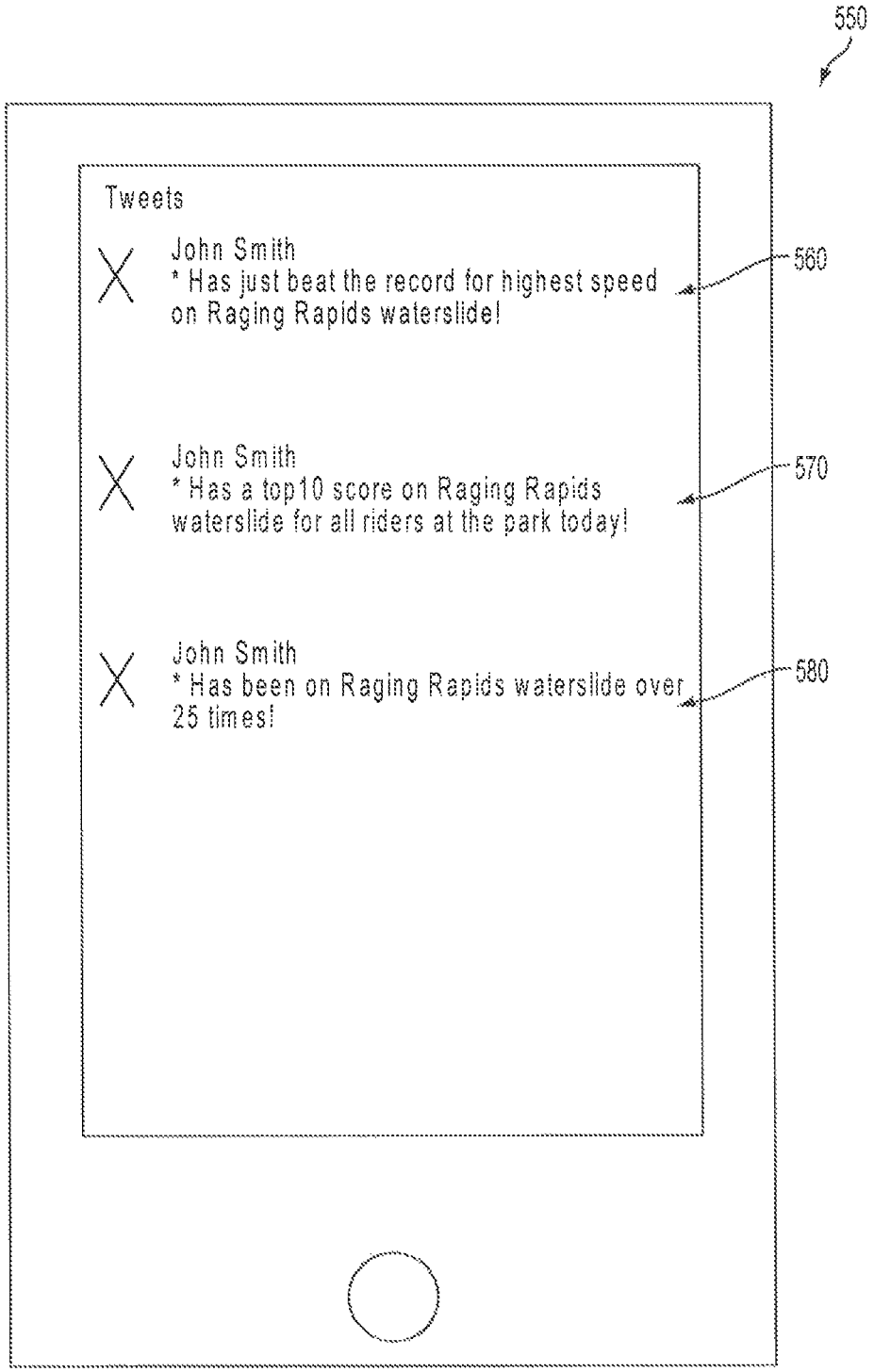
FIG. 5B shows a display of a social media account linked with a waterslide attraction according to an embodiment of the present invention.

Turning next to FIG. 5B, a display 550 of a social media account or device linked with a waterslide attraction is shown. The waterslide attraction may be capable of incorporating skill or agility of a user thereon and may include features that are the same as or similar to those previously described or discussed further herein. For example, various statistics may be tracked or generated by the waterslide attraction or a system interfacing with the waterslide attraction based on tags (e.g., RFID tags) worn by a user riding on the waterslide attraction or integrated into a ride vehicle. These statistics may be data such as score of the user, speed of the user, elapsed time of the user, number of times the user has been on the attraction, etc. To allow users to easily or conveniently share their performance or these statistics with friends and family, a social media account or other user profile may be linked with or configured to receive signals from the waterslide attraction or its interfaced system.

In one example, as shown, a twitter account for the user may be associated with one or more tags connected to the user or the ride vehicle for enabling the waterslide attraction to automatically post information to the user's account based upon ride participation. As shown, a first message 560 indicating that a user (e.g., "John Smith") has beat the record for highest speed on a particular waterslide (e.g., "Raging Rapids") may be automatically transmitted by the waterslide attraction to the user's associated account when the waterslide attraction determines a new speed record for the user has been accomplished based upon the tracked or generated statistics. A second message 570 indicating that the user has received a top10 score on a particular waterslide out of all visitors at the park in a given day may be automatically transmitted by the waterslide attraction to the user's associated account by comparing the tracked or generated statistics for the user to the tracked or generated statistics for all other users at the park. A third message 580 indicating that the user has been on a particular waterslide more than a predetermined number of time (e.g., 25) may be automatically transmitted by the waterslide attraction to the user's associated account upon such a determination by the waterslide attraction based upon the tracked or generated statistics.

The above messages are merely exemplary and any of a variety of automated messages or other data may be sent or posted to a user's associated account. Moreover, other forms of social media or other accounts in addition or alternatively to a twitter account may also be utilized (e.g., Facebook, Google+, email, etc.) for the sharing of user statistics. Furthermore, data may be shared to a user's account that is not based upon user statistics generated by the ride. For example, a still camera or video camera may be incorporated onto a waterslide attraction that takes a user's photograph or a video clip while the user rides the waterslide attraction, the photograph or video clip available for upload to the user account. Such photography may allow for older water or amusement rides to be easily retrofitted to utilize media sharing, but without a large expense in incorporating readers, triggers, or other such components for statistic generation.

The uploading or transmittal of messages, photographs, video clips, or other data may be free of charge to the user, may require an additional fee consented to by the user (for example, after ride completion), or may result from a heightened fee charged to the user upon entrance to the park. The associated account of a user may be determined by the ride attraction via a trigger device worn or otherwise disposed on the user that contains the relevant account information and capable of being read by sensors or readers of the waterpark or waterslide attractions. In one embodiment, RFID tags worn by the user or contained in a ride vehicle utilized by the user for generating the various ride statistics or data may also contain information for associating with the user's account.

Figure 6A:
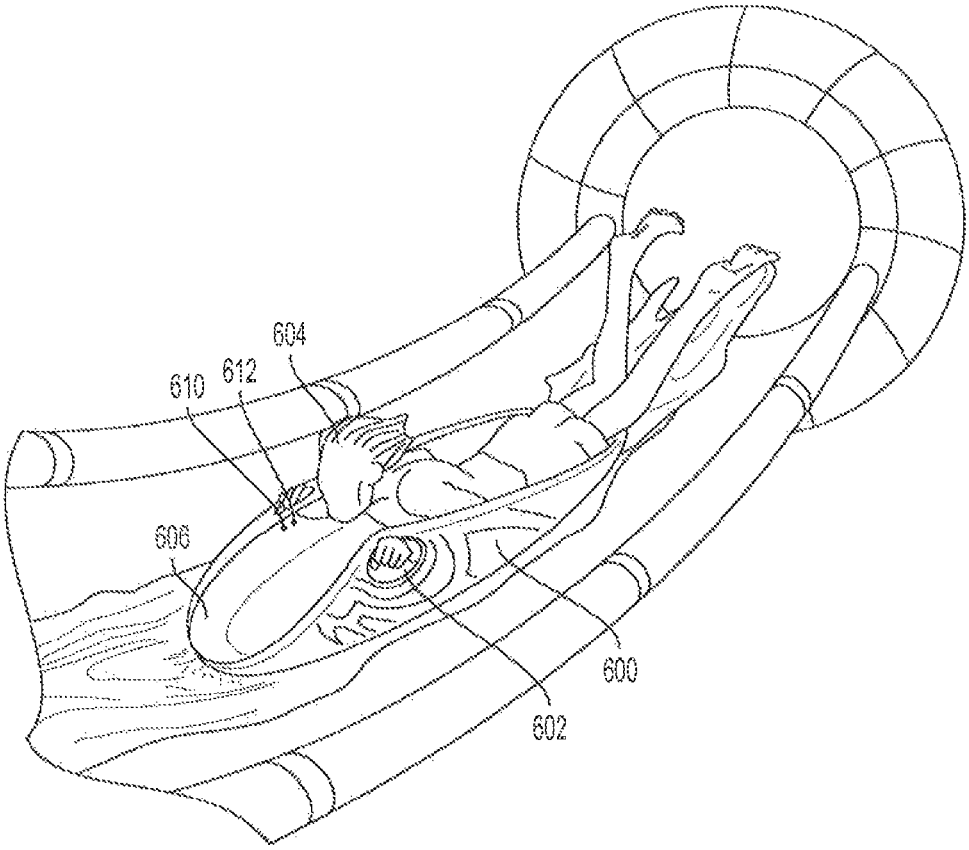
FIG. 6A shows a perspective view of a segment of a waterslide attraction in use by a rider for demonstrating a slideboard layout according to an embodiment of the present invention.
Figure 6B:
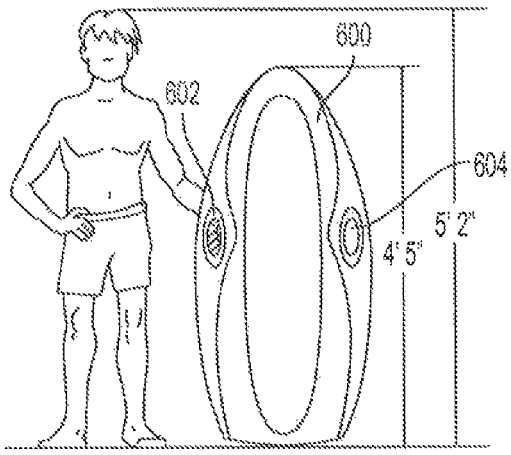
FIG. 6B shows a front view of the slideboard of FIG. 6A for demonstrating dimensions of the slideboard according to an embodiment of the present invention.

FIGS. 6A and 6B show a perspective view and a front view of a slideboard 600, respectively. The slideboard 600 is a ride vehicle configured to support a user thereon while traveling down a sliding surface of a waterslide attraction. The waterslide attraction may be the same as or similar to those previously discussed. The slideboard 600 preferably has two handles (602, 604) and a curved middle portion 606 for allowing the user to manually manipulate the position of the slideboard 600 upon the sliding surface of the waterslide attraction, for example, by tugging on one or more of the handles (602, 604), and/or shifting their weight upon the middle portion 606. A bottom surface of the slideboard 600 may be shaped, constructed or coated with any of a variety of materials to improve the speed or aerodynamics of the slideboard 600 and/or to give the slideboard 600 a sportier look and feel. The front of the slideboard 600 may be shaped to allow for improved steering (e.g., in the shape of a bow of a boat) and/or may be configured in a turned-up fashion to allow for skiing over water during travel in the waterslide attraction.

The same as or similar to previous discussions, the slideboard 600 may include tags, plates or other components coupled therewith or embedded therein and designed to interface with various sensors, energized or magnetized elements, or other components coupled with or embedded in the waterslide attraction. Moreover, the same as or similar to previous discussions, the slideboard 600 may additionally or alternatively include one or more activation mechanisms (e.g., buttons or other user-manipulatable elements) coupled therewith or embedded within. These activation mechanisms may transmit a signal when manipulated (e.g., pressed) to a receiver (e.g., an RF receiver), processor, controller or other sensor located on or adjacent to a sliding surface of the waterslide attraction. The controller or other sensor may then cause or activate a feature of the waterslide (e.g., lights, sounds, sprays of water, a message to another user, cause a photograph or video to be taken or recorded, etc.), the same as or similar to the previous discussions.

In the embodiment shown a plurality of activation mechanisms (610, 612) are positioned adjacent to a handle or portion of the slideboard 600 that a user grips with his or her hand. Similarly, additional activation mechanisms (obscured from view) may be disposed on the opposite side of the slideboard 600, near the user's other hand. In one example, the activation mechanisms (610, 612) may be buttons (e.g., with different colors, shapes, etc. associated therewith) that the user can activate by pressing on them with his or her fingers or thumbs. As the user slides down the water attraction, the user may activate certain of the activation mechanisms (610, 612) by manipulating them at a corresponding time in response to a corresponding stimulus (e.g., as the user passes by a blue light, the user has a predetermined amount of time to press a blue button in order to activate or trigger a particular waterslide effect).

The activation mechanisms (610, 612) may be removable from the slideboard 600 in certain embodiments (e.g., either individually or as a group mounted to a common component, such as a bracket, gamepad, etc.). In one example, the slideboard 600 may include handles (602, 604) with buttons disposed thereon or adjacent thereto, the portion of the handles containing the buttons being removable from the slideboard 600. In another example, a gamepad or other component containing activation mechanisms thereon or therein may clip, clamp, or otherwise secure to a portion of the slideboard 600 (e.g., the middle portion 606 in front of the user). This may improve the cost effectiveness of a slideboard since the more costly electronic components can be removed and placed onto a different slideboard once wear-and-tear makes the original slideboard no longer fit for use by customers. In an alternative embodiment, the slideboard 600 may be configured to receive a gamepad or controller with buttons and hold or couple the gamepad or controller to the slideboard 600 (e.g., via a clip or receiving socket). Users may purchase and own their gamepad or controller and plug it in to the slideboard 600 when participating on the water attraction. In such an embodiment, the gamepad or controller may include a unique tag or identification for the user, the same or similar to previous discussions.

In certain embodiments, the slideboard 600 may have inflatable portions. The slideboard 600 may be customizable by or for a user, for example, by waxing the outer surface or by adding/removing air or other gasses from the inflatable portions. The slideboard 600 may be rented by a user upon visiting a waterpark or may be owned by the user and brought to the waterpark. In one embodiment, badges or other indications of performance may be rewarded or obtained by users based upon their performance or achievement for inclusion onto their owned slideboard 600. Waterparks may provide stations, either for free or for charge, that allow users to wax or otherwise customize the appearance or the performance of the slideboard 600 while within the waterpark.

Any of a variety of dimensions may be used for the slideboard 600. For example, the slideboard 600 may be approximately 85% as long as its user (e.g., a 5'2" user may use a 4'5" long slideboard 600). In alternative embodiments, the slideboard 600 could be longer than the user, equal in length to the user, or shorter than the user. Although only a single-user slideboard 600 is shown in FIGS. 6A and 6B, slideboards may be created for any number of individuals (e.g., single, double, family teams, etc.). For example, family team slideboards may be set-up similar to toboggans where riders sit behind each other and cooperate as a team to achieve optimal performance. In certain embodiments, the slideboard 600 may be configured to wrap around a user's back, like a cocoon, and held in place by the user crossing his or her arms over their chest.

Figure 7A:
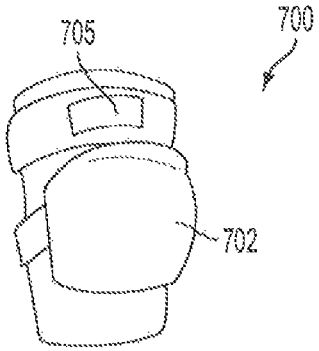
FIG. 7A shows an elbow pad accessory for use with a waterslide attraction capable of incorporating skill or agility of a user riding thereon according to an embodiment of the present invention.
Figure 7B:
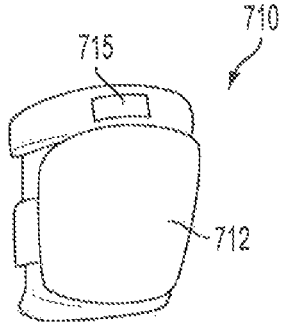
FIG. 7B shows a knee pad accessory for use with a waterslide attraction capable of incorporating skill or agility of a user riding thereon according to an embodiment of the present invention.

FIGS. 7A-7D show a plurality of accessories that may be worn by a user of a waterslide attraction. The waterslide attraction may be capable of incorporating skill or agility of the user thereon and may include features that are the same as or similar to those previously described. FIG. 7A shows a front view of an elbow pad 700. The elbow pad 700 includes a hardened surface 702 for helping protect an elbow of the user and may also incorporate a tag 705 (e.g., an RFID tag) therein for interfacing with one or more sensors along the waterslide attraction, as previously discussed. In an alternative embodiment, no tag may be included in the elbow pad 700. Similarly, FIG. 7B shows a knee pad 710 including a hardened surface 712 for helping protect a knee of the user and may also incorporate a tag 715 (e.g., an RFID tag) therein for interfacing with one or more sensors along the waterslide attraction, as previously discussed. In an alternative embodiment, no tag may be included in the knee pad 710. In certain embodiments, the elbow pad 700 and/or the knee pad 710 may be made of a neoprene and Lycra sewn construction with plastic elbow and/or knee coverings.

Figure 7C:
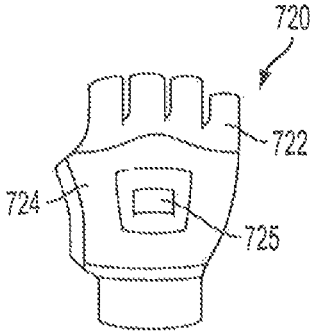
FIG. 7C shows a glove accessory for use with a waterslide attraction capable of incorporating skill or agility of a user riding thereon according to an embodiment of the present invention.
Figure 7D:
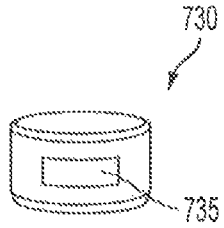
FIG. 7D shows a wrist or ankle band accessory for use with a waterslide attraction capable of incorporating skill or agility of a user riding thereon according to an embodiment of the present invention.

FIG. 7C shows a front view of a glove 720. The glove 720 includes a flexible and thinner portion 722 for surrounding fingers of the user and a padded center portion 724. The glove 720 may also incorporate a tag 725 (e.g., an RFID tag) therein for interfacing with one or more sensors along the waterslide attraction, as previously discussed. In an alternative embodiment, no tag may be included in the glove 720. Similarly, FIG. 7D shows a band 730 for incorporating a tag 735 (e.g., an RFID tag) therein for interfacing with one or more sensors along the waterslide attraction, as previously discussed. The band 730 may be configured to wrap around a wrist of the user. In an alternative embodiment, the band 730 may be configured to wrap around an ankle or other body part of the user (e.g., a finger or a toe). In certain embodiment, the glove 720 and/or the band 730 may be made of a neoprene and Lycra sewn construction with sewn-in or otherwise embedded RFID tags.

Figure 8A:
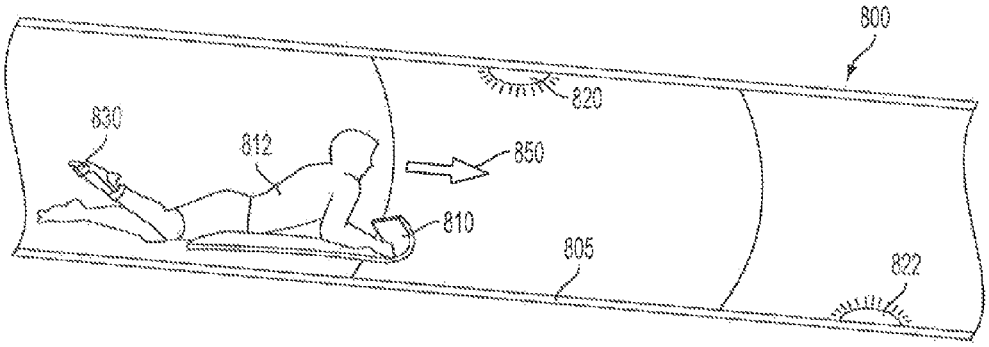
FIG. 8A shows a side view of a slide portion of a waterslide attraction capable of incorporating skill or agility of a rider thereon at a first position with a sensor attached to an foot of the rider according to an embodiment of the present invention.
Figure 8B:
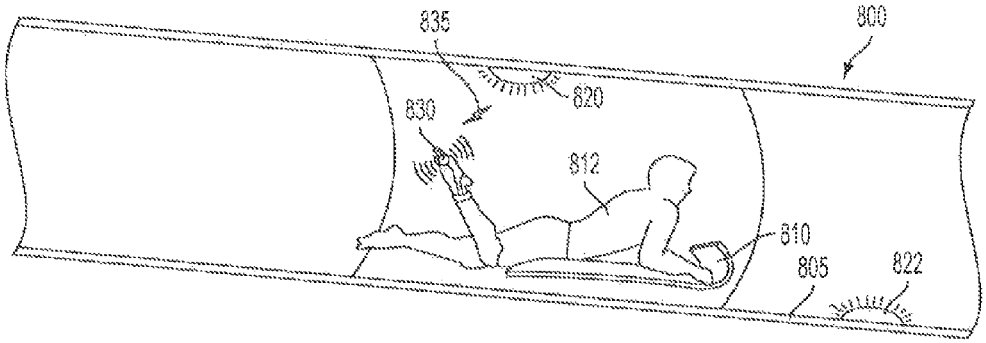
FIG. 8B shows a side view of the slide portion of the waterslide attraction of FIG. 8A with the rider at a second position with the sensor attached to the foot of the rider according to an embodiment of the present invention.
Figure 8C:
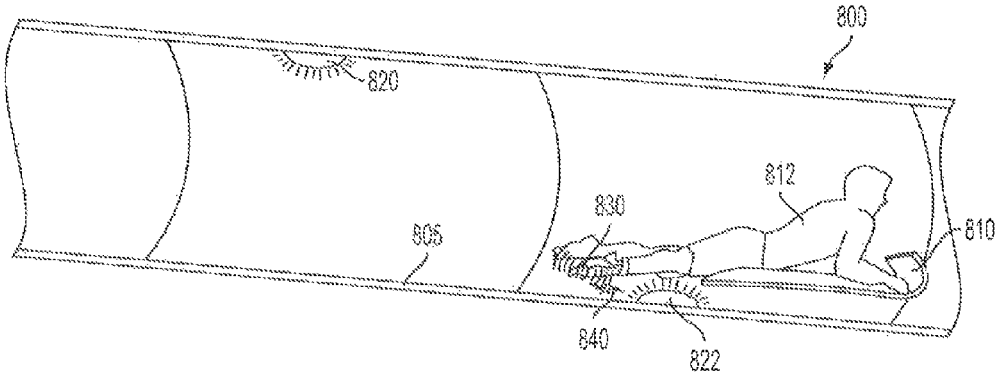
FIG. 8C shows a side view of the slide portion of the waterslide attraction of FIG. 8A with the rider at a third position with the sensor attached to the foot of the rider according to an embodiment of the present invention.

Turning next to FIGS. 8A-8C, a waterslide attraction 800 is shown having a sliding surface 805 upon which a rider 812 upon a mat 810 or other riding board or vehicle may slide down along a main travel path 850 from an entrance location to an exit location. The waterslide attraction 800 may contain features that are the same as or similar to those previously discussed. In certain embodiments, no mat 810 or other riding board or vehicle may be used. The same or similar as previously discussed, the waterslide attraction 800 incorporates sensors or readers (820, 822) at various locations along the waterslide attraction 800. The readers (820, 822) are configured to sense or otherwise detect a tag 830 or other element that is worn around or near a foot or ankle of the rider 812 when the tag 830 is within a predetermined proximity of the particular reader (820, 822).

The readers (820, 822) may also include indicator elements or components (e.g., lights, LEDs, sounds) such that as the rider 812 activates the readers (820, 822) or fails to activate the readers (820, 822) when in their proximity, the readers (820, 822) provide the rider 812 with an indication of such success or failure. As demonstrated in FIG. 8A, the rider 812 is initially in a first position where no readers (820, 822) are within a proximity to be activated and thus the position of the foot of the rider 812 is of no consequence. However, as demonstrated in FIG. 81, as the rider 812 travels along the main travel path 850 and gets closer to the first reader 820 located above the rider 812 in the waterslide attraction 800, the rider 812 must skillfully raise their foot with the tag 830 such that the first reader 820 appropriately senses 835 the tag 830 (e.g., via radio communication). Further, as demonstrated in FIG. 8C, as the rider 812 continues to travel along the main travel path 850 and gets closer to the second reader 822, located below the rider 812 in the waterslide attraction 800, the rider 812 must skillfully lower their foot with the tag 830 such that the second reader 822 appropriately senses 840 (e.g., via radio communication) the tag 830.

Since the rider 812 may be using their hands or arms to help steer the mat 810 along the sliding surface 805, tags 830 placed on one or more of the users feet, ankles, or legs may provide an added level of difficulty or challenge for the rider 812 in attempting to obtain a high score while riding the waterslide attraction 800. Thus, individuals who are not as skilled or do not wish to attempt a more difficult run may be permitted to utilize the waterslide attraction 800 without any tags 830 located on their feet, ankles, or legs. For example, the first reader 820 may be disabled for such attempts on the waterslide attraction 800 since the only tags to be read on the given attempt may, for example, be located in the mat 810 itself. Alternative embodiments may see the tag 830 placed in additional or alternative locations on the rider 812. As previously mentioned, in an alternative embodiment, rather than moving a tag worn by a rider within a vicinity of a reader for successful activation, a tag may be included as part of a gamepad or as part of a ride vehicle and a user may be required to successfully press a corresponding button or element when within a vicinity of the reader, in response to a visual or audible cue (e.g., pressing a blue button in response to a blue light). Pressing the button or element causes a signal to be received by a reader or controller within a vicinity of the tag, to either modify a feature of the attraction, the same as or similar to previous discussions, and/or to accumulate points to determine a score for the rider, the same as or similar to previous discussions.

Figure 9A:
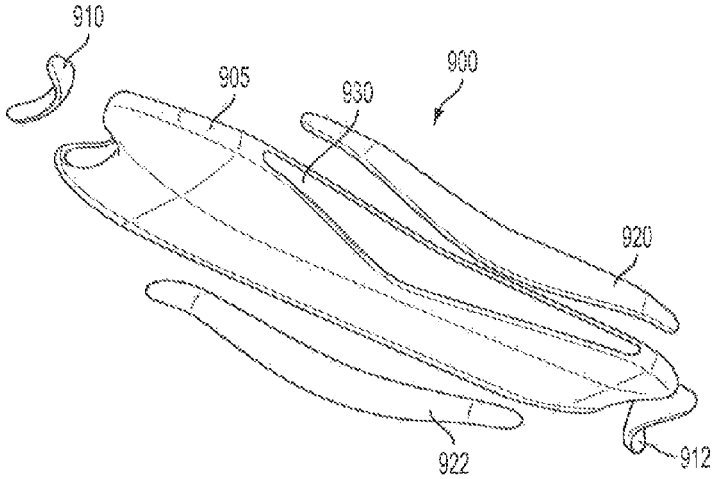
FIG. 9A shows a perspective view of an inflatable ride vehicle having panels for incorporation therein according to an embodiment of the present invention.
Figure 9B:
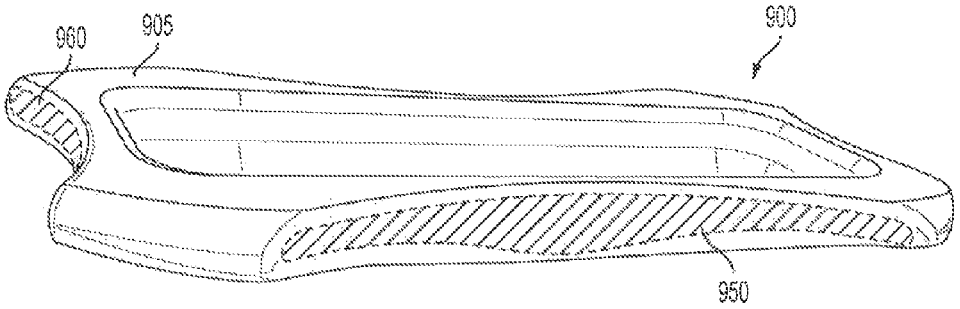
FIG. 9B shows a side view of the inflatable ride vehicle of FIG. 9A having panels incorporated therein according to an embodiment of the present invention.
Figure 9C:
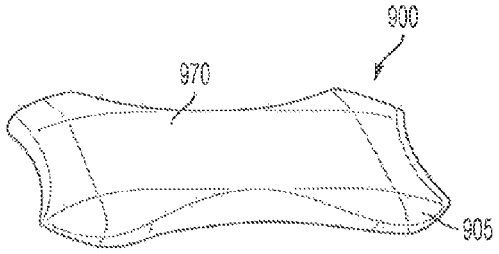
FIG. 9C shows a perspective view of the bottom of the inflatable ride vehicle of FIG. 9A having panels incorporated therein according to an embodiment of the present invention.

A number of possible ride vehicles may be used by a rider when navigating down a waterslide attraction. For example, one such ride vehicle is shown by FIGS. 9A-9C. An inflatable ride vehicle 900 is shown that has an inflatable body portion 905 that is configured to receive a plurality of rigid or semi-rigid panels (910, 912, 920, 922) therein. Pockets 930 within the body portion 905 are disposed at the desired locations where the panels (910, 912, 920, 922) are to be held in place within the body portion 905. The panels (910, 912, 920, 922) are used to achieve various concave, convex, or other shapes in the inflatable body portion 905. For example, concave shapes via the panels (910, 912) may create projections aft and fore of the raft, effectively creating bumpers. Such a configuration may improve tracking in straight sections of a flume ride and/or increase the efficacy of linear induction motors in an amusement attraction. Moreover, the configuration may also simultaneously minimize lateral bridging that can occur in curved sections of the flume ride.

As shown in FIG. 9B, various of the panels (910, 912, 920, 922) are disposed within the body portion 905, for example at perimeter locations 950 and 960. Integration of such panels into an inflatable structure can create shapes for the ride vehicle 900 that otherwise would not be possible, for example, to counteract the natural tendency of inflated structures to bow out into convex lines. In this manner, the ride vehicle 900 may be created with perfectly flat or defined surfaces, for example along a bottom location 970 as seen in FIG. 9C. In this manner, ride vehicles with increased specificity in dimensions or shape may be created to better travel or be manipulated while traveling along a waterslide attraction. In addition, tags (e.g., RFID tags) may more easily be accommodated by or affixed to one or more of the panels (910, 912, 920, 922) rather than the material making up the inflatable body portion 905.

Figure 10:
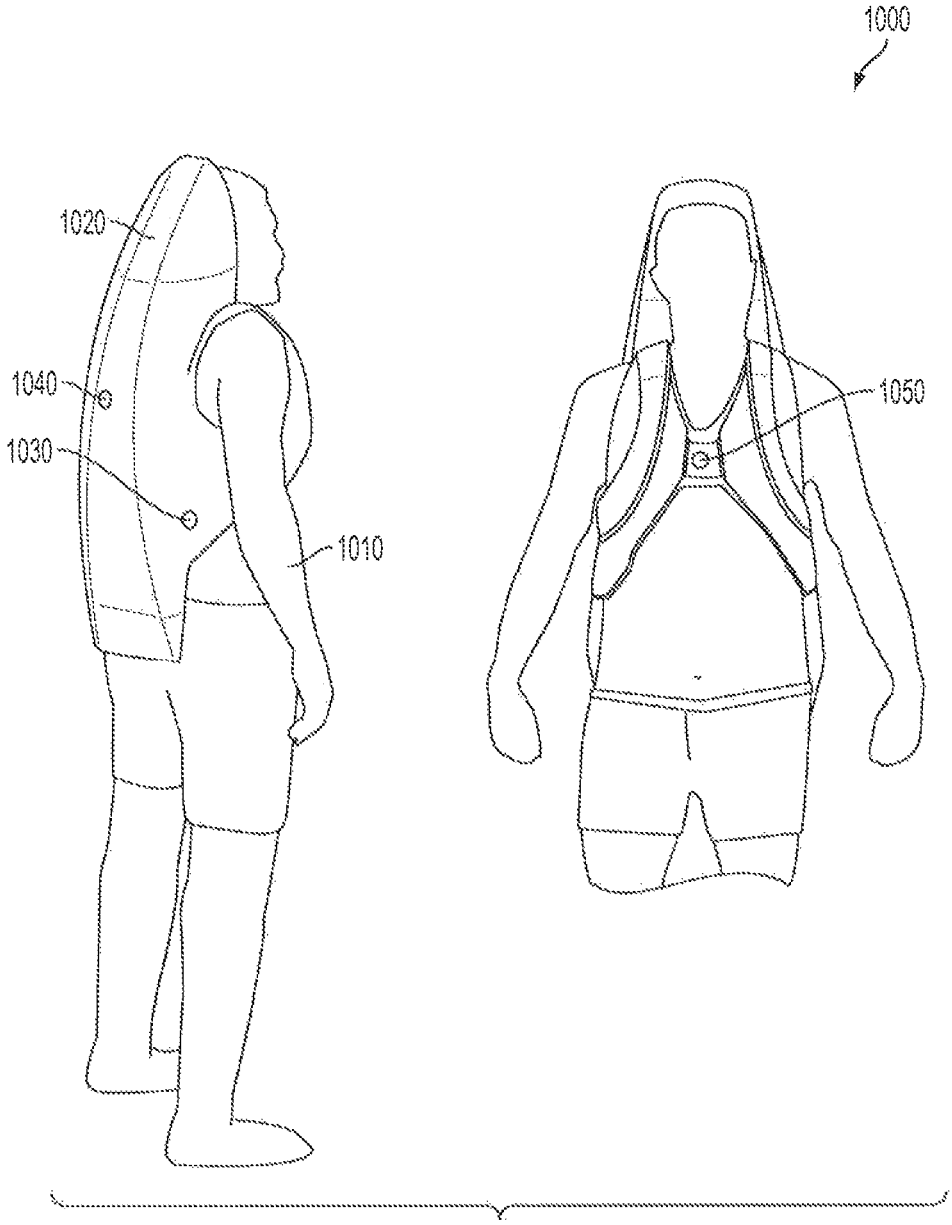
FIG. 10 shows perspective and front views of a protective maneuvering ride vehicle worn by a rider for navigating a waterslide attraction according to an embodiment of the present invention.

FIG. 10 shows another possible ride vehicle that may be used by a rider when navigating down a waterslide attraction. A protective maneuvering vehicle 1000 includes a rigid or semi-rigid body 1020 that is configured to wrap around the body of a rider 1010, for example, as shown. The body 1020 helps protect the rider 1010 during movement on the waterslide attraction by providing a protective buffer between the rider 1010 and a sliding surface of the waterslide attraction. Thus, the upper body of the rider 1010 (e.g., from the hips and above, including the back, shoulders, neck, and/or head) may not make contact with the sliding surface of the waterslide attraction and instead are safely surrounded or received by the body 1020. Not only can such a ride vehicle provide protection to the neck, spine, or other joints of the body of the rider 1010, but may also increase rider comfort, for example, by minimizing scrapes or rubs upon the body of the rider that might otherwise occur due to skin contact with the sliding surface of the waterslide attraction or by having additional padding between the rider's body and the slide surface.

A plurality of tags (e.g., RFID tags) may be disposed on or in the body 1020 of the protective maneuvering vehicle for the incorporation of rider skill or for the manipulation of other ride features or aspects, the same or similar as previously discussed. For example, a first RFID tag 1030 may be located on a first side portion of the body 1020, a second RFID tag 1040 may be located on a back portion of the body 1020, a third RFID tag (obscured from view) may be located on a second side portion of the body 1020 opposite the first side portion, and a fourth RFID tag 1050 may be located on a front portion of the body 1020. The RFID tags (1030, 1040, 1050) may have unique identifiers such that they can be independently sensed by sensors or readers along the waterslide attraction. For example, the first RFID tag 1030 and the third RFID tag may be color coded as yellow for corresponding to the side portions of the body 1020, the second RFID tag 1040 may be color coded as green for corresponding to the back portion of the body 1020, and the fourth RFID tag 1050 may be color coded as red for corresponding to the front portion of the body 1020.

Readers capable of sensing a nearby RFID tag may similarly be color coded and configured to determine when an RFID tag of the same color is within a predetermined distance. For example, a portion of a water slide having a reader adjacent thereto may be painted red or otherwise illuminated with a red light to indicate to the rider 1010 that the fourth RFID tag 1050 positioned on the front side of the body 1020 (also color coded red) should be positioned within a close proximity. Thus, if the rider 1010 is currently riding the waterslide on their back (i.e., the second RFID tag 1040 located on the back portion of the body is positioned adjacent to the sliding surface of the waterslide), the rider 1010 will be required to spin their body such that they are instead riding the waterslide on their stomach (i.e., the fourth RFID tag 1050 located on the front portion of the body 1020 is positioned adjacent to the sliding surface of the waterslide) in order for the reader to sense the desired RFID tag and therefore manipulate some other aspect of the ride (e.g., provide score points, etc.). Thus, as the rider 1010 travels down the waterslide while wearing the protective maneuvering vehicle 1000, the rider may spin, rotate, twist, or otherwise manipulate themselves and the body 1020 such that the appropriate RFID tag (1030, 1040, and 1050) is within proximity of a corresponding reader.

In this manner, different difficulties for the same waterslide attraction may be obtained for accommodating a wider variety of audiences. For example, on the easiest difficulty, any RFID tag upon the body 1020 sensed by a reader along the slide will still provide score points and are not distinguished amongst. On a medium difficulty, the RFID tags upon the body 1020 may be segregated into two groups: (1) front/back tags and (2) side tags, a reader along the slide configured to distinguish between the two groups. On a hard difficulty, the RFID tags upon the body 1020 may be segregated into three groups: (1) a front tag, (2) a back tag, and (3) side rags, a reader along the slide configured to distinguish between the three groups. Alternative embodiments may utilize different configurations of tag groups for providing varying levels of difficulty.

In another alternative embodiment, the protective maneuvering vehicle 1000 may wrap completely around the head of the rider 1010. A screen or display may be located within and displayed to the rider 1010 for providing notifications such as current score, a map of the waterslide sliding surface and instantaneous position thereon, locations of upcoming sensors to be activated, information concerning which RFID tag should be moved adjacent to an upcoming sensor, etc. The screen or display may also be used to further a competitive facet of the waterslide attraction, for example by displaying the score, speed, location, time or other aspect of a rider traveling on a different, complementary flume (e.g., an adjacent, dueling flume of a waterslide attraction) or of a rider that immediately proceeded the rider 1010 on the same flume. Historical information for the rider 1010 may also be displayed on the screen or display, such as their previous fastest time, previous highest score, or other statistics for the waterslide attraction. Alternatively, a mobile device could be mounted in the protective maneuvering vehicle 1000 and configured to display dynamic information to the rider in a heads up display. The mobile device may be provided by the amusement park or waterpark or may be a device owned by the rider (e.g., a smart phone) that can clip or otherwise fasten within the protective maneuvering vehicle 1000.

Figure 11:
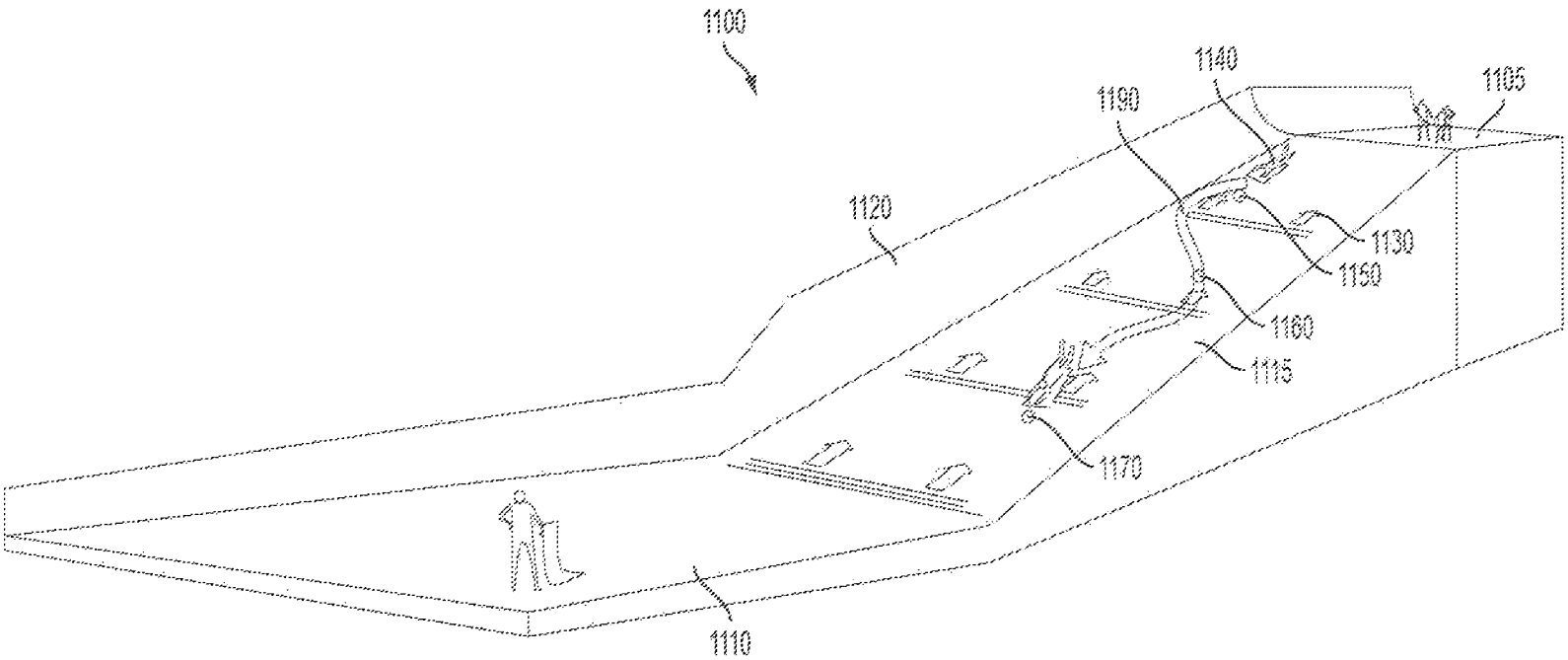
FIG. 11 shows a perspective view of a sloped waterslide attraction utilizing a plurality of water jets for incorporating rider skill or agility during use according to an embodiment of the present invention.

FIG. 11 shows a perspective view of an alternative waterslide attraction utilizing a plurality of water jets and a sloped surface for incorporating rider skill or agility. The waterslide 1100 has an entrance area 1105, an exit area 1110, and a sloped transition area 1115. A rider 1140 uses a mat or other ride vehicle to move down the sloped transition area 1115. Water jets 1130 or nozzles propel water upwardly along the sloped transition area 1115 in a direction opposing the downward movement of the rider 1140. The water jets 1130 propel water at a rate and volume sufficient to slow down movement of the rider 1140, but not enough to cease downward movement of the rider. Thus, a given rider 1140 will always be maintaining downward motion from the entrance area 1105 towards the exit area 1110, but is allowed to carve side-to-side via the mat or other ride vehicle along the wide transition area 1115.

Although FIG. 11 shows the water jets 1130 propelling water in-line with the slope of the transition area 1115 from the exit area 1110 to the entrance area 1105, in an alternative embodiment, the water jets 1130 may propel water from the sides of the transition area 1115 at an angle (e.g., 45 degrees) and drain at or near side portions 1120 to prevent water from bunching up and/or overflowing down towards the exit area 1110. Moreover, angled water jets may allow for a more even distribution of water across the surface of the transition area 1115. The rider 1140 may compensate for the angled travel of water flow by carving into the flow. Moreover, the side portions 1120 may form a curved shape such that the rider 1140 is permitted to move at least partially up the side portions 1120 by carving into the water flow. In certain embodiments, the surface of the transition area 1115 may be a fabric or other riding surface with sensors located in or below the surface.

In one embodiment, one or more targets may be placed and/or illuminated along the transition area 1115. These targets may be sensors configured to read or detect when a tag (e.g., an RFID tag) coupled to the rider 1140 or the mat or other ride vehicle is within a predetermined vicinity. For example, a first target 1150, a second target 1160, and a third target 1170 may be incorporated on or in the transition portion at different distances from the side portions 1120. Thus, in order to achieve the maximum score by activating the targets, the rider 1140 must manipulate their position along the transition portion 1115 by carving into the water flow along the path 1190 as shown. The speed of the water flow may be manipulated to increase or decrease the level of difficulty of the course. Similarly, different embodiments may utilize different numbers of targets and/or different configuration or orientation of targets along the transition portion 1115 leading to a more rides of varying difficulty or challenge.

Various modifications or alterations may be made to the waterslide attractions discussed above. For example, a particular slide apparatus may utilize any of a number of bumps, jumps, turns, twists, flips, curves, angles, hills, valleys, etc. in order to create an exciting ride path for users. Various lighting, sound effects, vibration effects, or other features or thematic experiences may be included in a particular slide apparatus to garner user attention or excitement. Sensors disposed along the slide apparatus may be used to recognize when a user is approaching for cueing the user, tracking the exactness of the user's ability to hit an upcoming sensor, credit or detract score points for hitting or missing the upcoming sensor, and/or assigning a score, reward and/or time to the user.

A particular slide apparatus may be configured using the same or similar features described above for single riders, double riders, or family riders. Sensors may be included within a ride vehicle instead of along the slide path. Moreover, tags or other devices may be included at any of a variety of locations on the ride vehicles (e.g., along the bottom, on the sides, etc.). Other technologies than those explicitly described above may be used for boosting or slowing in speed a rider or a ride vehicle. Moreover, other technologies than those explicitly listed could be used as triggers as a vehicle or a rider passes thereby (e.g., magnets within the vehicle or worn by the rider may trip magnetic switches, infrared light beams positioned at locations on the slide path may be tripped by the vehicle or the rider interrupting the light path, etc.).

The difficulty of a given ride utilizing competitive elements as discussed (e.g., score-generated targets) may have an automatically adapting difficulty level based upon user history or attributes. For example, if a user has ridden on a particular waterslide beyond a certain number of times, is above a certain age, has achieved a predetermined performance threshold on previous attempts, and/or any of a variety of other user data, the waterslide may automatically or dynamically adjust the difficulty level by adding targets for the user to hit, enabling more difficult to hit targets or configurations, or by manipulating the water flow or one or more jets of water utilized in the ride. Moreover, the difficulty level of a particular waterslide may automatically adapt in the middle of a user's run. For example, if the user is poorly performing at a given difficulty during the initial portion of the waterslide, the difficulty may be eased for later portions of the waterslide, for example by reducing the number of targets to hit or manipulating the water flow or one or more jets of water utilized in the ride. In this manner, the fun factor may be maintained at a high level and the chance of harsh difficulty spikes a user may otherwise encounter is reduced.

Utilization of sensed tags and/or social media interaction by a waterpark or amusement park may allow for increased population within the park outside of typically popular timeframes. In one example, a waterpark may be busiest during the hottest hours of the day and commonly close during evening or nighttime hours when younger children that typically populate the park have left for bed. At this time, a second phase for the park may be initiated for teenagers or older children that incorporates readers (e.g., RFID sensors), targets, or other interactive elements disposed around the park and designed to interface with park visitors. Scavenger hunts, races, or any of a variety of other competitive features or interactive games may be developed and used to maintain park attendance even during the normally closed or less populated timeframes. Scoreboards may be placed throughout the park and/or social media accounts may be associated with park visitors to further facilitate competitive participation among the park visitors.

Any of the above features discussed may be utilized or incorporated or combined with or into other waterpark or amusement park attractions discussed or retrofitted onto existing waterpark or amusement park ride designs. The previous description of the disclosed examples is provided to enable any person of ordinary skill in the art to make or use the disclosed methods and apparatus. Accordingly, the terminology employed throughout should be read in a non-limiting manner. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and/or methods.

What is claimed is:

1. A waterslide for incorporating skill or agility of a rider comprising:

a slide;

a ride vehicle configured to support the rider thereon and travel along the slide, the ride vehicle having an activation mechanism configured to be activated by the rider as the rider travels along the slide;

a sensing component adjacent to the slide for determining a position of the ride vehicle on the slide; and a reward component configured to reward the rider based on activation of the activation mechanism by the rider and the position of the ride vehicle on the slide.

2. The waterslide of claim 1 wherein the reward component is a speed-adjusting component coupled with the slide and configured to adjust a speed of the ride vehicle.

3. The waterslide of claim 1 wherein the reward component is a speed-adjusting component coupled with a second slide and configured to adjust a speed of a second rider that is traveling on the second slide.

4. The waterslide of claim 1 wherein the reward component includes a light adjacent to the slide and configured to illuminate if the ride vehicle is within a predetermined distance of the sensing component when the activation mechanism is activated by the rider.

5. The waterslide of claim 1 wherein the reward component includes a speaker adjacent to the slide and configured to provide an audible sound if the ride vehicle is within a predetermined distance of the sensing component when the activation mechanism is activated by the rider.

6. The waterslide of claim 1 wherein the reward component includes a processor configured to calculate a score for the rider based on the ride vehicle being within a predetermined distance of the sensing component when the activation mechanism is activated by the rider.

7. The waterslide of claim 1 wherein the reward component includes a processor configured to reduce a score of a second rider on a second slide based on the ride vehicle being within a predetermined distance of the sensing component when the activation mechanism is activated by the rider.

8. The waterslide of claim 1 further comprising a second sensing component configured to interact with the first sensing component when the second sensing component is within a predetermined distance from the first sensing component.

9. The waterslide of claim 8 wherein the second sensing component is coupled with the ride vehicle.

10. The amusement attraction of claim 1 wherein the sensing component is coupled with the slide.

11. A ride vehicle for an amusement slide comprising:

a supporting surface configured to support the rider thereon and travel with the rider on the amusement slide;

a handle coupled with the supporting surface and configured to be held by the rider;

a processor configured to determine a position of the supporting surface along the amusement slide; and an activation mechanism in communication with the processor and adjacent to the supporting surface, the activation mechanism configured to be activated by the rider while the rider travels on the amusement slide.

12. The ride vehicle of claim 11 wherein the activation mechanism is a button connected to the handle.

13. The ride vehicle of claim 12 wherein the handle is configured to be removable from the supporting surface.

14. An amusement attraction for incorporating skill of a rider comprising:

a surface for supporting the rider thereon;

at least one sensing component coupled with the surface;

a controller having at least one element for manipulation by the rider while the rider rides on the surface, the controller configured to transmit a signal based upon manipulation of the at least one element by the rider;

a receiver configured to receive the signal; and a feature of the amusement attraction configured to respond based upon receipt of the signal by the receiver if at least one button is manipulated by the rider when the rider is within a predetermined proximity to the at least one sensing component.

15. The amusement attraction of claim 14 wherein the feature includes a light coupled with the surface and configured to respond by illuminating.

16. The amusement attraction of claim 14 wherein the feature includes a speed-adjusting component coupled with the surface and configured to respond by adjusting a speed of the rider.

17. The amusement attraction of claim 16 wherein the speed-adjusting component is a water jet.

18. The amusement attraction of claim 16 wherein the speed-adjusting component is an element disposed adjacent to the surface and configured to be electrified based upon receipt of the signal by the receiver.

19. The amusement attraction of claim 14 further comprising:

a tag coupled with the controller and having identification information associated therewith, wherein the feature includes a score for the rider and configured to respond by incrementing or decrementing the score.

20. The amusement attraction of claim 14 wherein the feature is a score for the rider and further comprising a scoreboard configured to display the score for the rider.

* * * * *